US008348399B2

(12) United States Patent
Gengrinovich

(10) Patent No.: US 8,348,399 B2
(45) Date of Patent: Jan. 8, 2013

(54) WHITE INK DELIVERY

(75) Inventor: Semion Gengrinovich, Ramat Gan (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 482 days.

(21) Appl. No.: 12/731,839

(22) Filed: Mar. 25, 2010

(65) Prior Publication Data

US 2011/0234711 A1 Sep. 29, 2011

(51) Int. Cl.
*B41J 2/175* (2006.01)

(52) U.S. Cl. ..... 347/85

(58) Field of Classification Search ..... 347/84–86, 347/89, 93, 95, 23, 30, 14
See application file for complete search history.

(56) References Cited

U.S. PATENT DOCUMENTS

| | | | | |
|---|---|---|---|---|
| 7,261,390 | B2 | 8/2007 | Nishino | |
| 7,354,127 | B2 | 4/2008 | Endo | |
| 7,837,314 | B2 * | 11/2010 | Kyoso | 347/85 |
| 8,047,628 | B2 * | 11/2011 | Niimi | 347/30 |
| 8,100,517 | B2 * | 1/2012 | Karppinen et al. | 347/85 |
| 2009/0027461 | A1 * | 1/2009 | Asada | 347/85 |
| 2009/0040249 | A1 | 2/2009 | Wouters et al. | |
| 2010/0231622 | A1 * | 9/2010 | Sasaki et al. | 347/85 |

FOREIGN PATENT DOCUMENTS

| | | | |
|---|---|---|---|
| JP | 2008188963 | A | 8/2008 |
| WO | 2008080895 | A1 | 7/2008 |

* cited by examiner

*Primary Examiner* — Kristal Feggins

(57) ABSTRACT

A method for white ink delivery includes circulating white ink through a white ink delivery system between successive print jobs; and in response to a time interval between two of the successive print jobs being greater than a threshold time interval, draining the white ink from the white ink delivery system.

20 Claims, 7 Drawing Sheets

WHITE INK DELIVERY

BACKGROUND

Inkjet printing technology creates images by ejecting small ink droplets onto a substrate from multiple nozzles attached to a printing head assembly. Inkjet printing is very versatile and can be used for a wide variety of printing applications. For example, inkjet printing devices are widely used to produce standard sized documents. However, inkjet printing devices are also often used to print images onto large signage items such as billboards and banners.

In this range of different applications, inkjet printers may be used to print images on a wide variety of different substrate materials. The substrate materials may differ in texture and other physical or chemical properties.

In printing items other than standard sized documents, such as signage, the substrate that receives the printing is often not of a white color. Nevertheless, the color accuracy of the printed image may be generally dependent on the whiteness of the surface on which it is printed. Consequently, a white layer may be applied to a substrate before an image is printed using an inkjet system.

However, the pigments used to create white inks are generally not well suited to inkjet printing technologies. For example, titanium dioxide ($TiO_2$) is a common white ink pigment and is generally three to four times heavier than pigments for other color inks. Thus, the higher density pigment typically precipitates and clogs the nozzles of inkjet systems. Consequently, a white layer is typically applied to a non-white substrate using an alternative printing method prior to having the color image applied by an inkjet printer.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

As mentioned above, white inks are generally not well suited to inkjet printing technologies. Consequently, a white layer is frequently printed onto a substrate using an alternate printing method before the color image is applied to the substrate by an inkjet printing method. In light of this and other issues, the present specification relates to systems and method for depositing or printing with white ink using inkjet technologies.

According to certain embodiments, a white ink delivery system may include a circulation system for circulating the white ink between successive print jobs. The circulation system may be attached to an application system for applying the white ink during the print job. The white ink delivery system may also be configured to drain the white ink in response to a time interval between two successive print jobs being greater than a threshold length. For example, the threshold length for draining the system may be 45 minutes. If 45 minutes pass without a print job being performed, then the system may be drained of white ink and flushed with a flushing solution.

Through use of a system or method embodying principles described herein, a practical white ink inkjet delivery system may be realized. Such a system may be combined with a color inkjet delivery system on the same printing apparatus. Thus, images being printed onto a non-white substrate may have a white ink layer and a color ink layer printed by the same machine. Consequently, printing costs may be reduced as inkjet printing is generally less expensive than other printing methods which are typically used for printing white inks.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
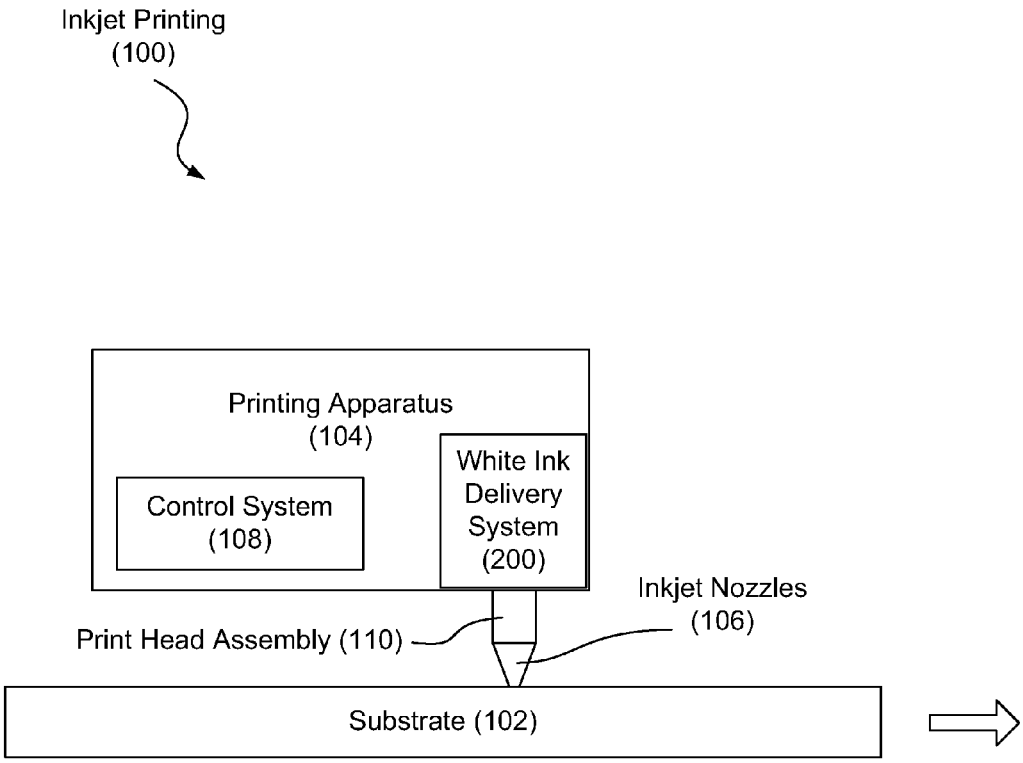
FIG. 1 is a diagram showing an illustrative apparatus for inkjet printing, according to one embodiment of principles described herein.

Referring now to the figures, FIG. 1 is a diagram showing an illustrative apparatus for inkjet printing (100). According to certain illustrative embodiments, a printing apparatus (104) may include a control system (108) and a print head assembly (110) having a number of inkjet nozzles (106). The printing apparatus (104) may be configured to push a substrate (102) past the nozzles (106) as ink is ejected. Additionally or alternatively, the printing apparatus may be configured to move the print head assembly (110) and nozzles (106) with respect to the substrate (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the printing apparatus (104). Additionally, the control system (108) may convert the image data sent from a computing system to a format which is readily usable by the printing apparatus (104).

The print head assembly (110) may be a structure designed to hold several print head modules. Each print head module may be spatially located so as to cover a specific range over the substrate (102). As the print head assembly (110) moves with respect to the substrate (102) and/or the substrate (102) moves underneath the print head assembly (110), the control system (108) may send a signal to the appropriate inkjet nozzle (106) attached to the print head assembly (110) to eject an ink droplet. Ink droplets are ejected in a specific pattern so as to create a desired image on substrate (102).

The inkjet nozzles (106) may be configured to eject ink onto the substrate (102) through a variety of methods. One method, referred to as thermal inkjet printing, includes a small ink chamber containing a droplet of ink. A heating resistor is used to heat the ink chamber to a specific temperature when an electric current is applied. Due to various physical properties, this heating increases the pressure inside the small ink chamber and propels the droplet out of the nozzle (106) and onto the substrate (102). The void in the chamber then draws in more ink from a reserve tank. The control system (108) may be used to cause electric current to flow through the appropriate heating resistors at the appropriate times.

As mentioned above, inkjet printers may be used to print images onto a wide variety of substrate (102) materials. Some substrate (102) materials may be of a non-white color or even transparent. A color image printed onto such a substrate (102) may lose a fair amount of color accuracy due to the absence of a white background. Such a loss of color accuracy causes the image to appear differently than intended.

As indicated above, this issue may be resolved by printing a white image onto the non-white substrate before printing the color image. However, as also mentioned above, white ink is generally not well suited to inkjet technologies. Thus, the white layer is often printed onto the non-white substrate before the substrate is provided to the inkjet printer to have the color image printed. The white layer may be printed using an alternate printing method such as screen printing. Alternate methods are typically more expensive as they may waste some of the white ink.

Consequently, the present specification discloses a method and system for providing and managing a white ink inkjet delivery system. Through use of such a white ink delivery system, a printing apparatus may use inkjet printing technology to print both a white ink layer and a color layer to produce a color accurate image on a non-white substrate material.

As shown in FIG. 1, a white ink inkjet delivery system (200) may be incorporated into the inkjet printing apparatus (100), which also prints colored inks as well. In other embodiments, the white ink inkjet delivery system (200) may be provided separately from a color inkjet printing apparatus. In either case, the white ink inkjet delivery system (200) will be described in further detail below with reference to FIG. 2.

Figure 2:
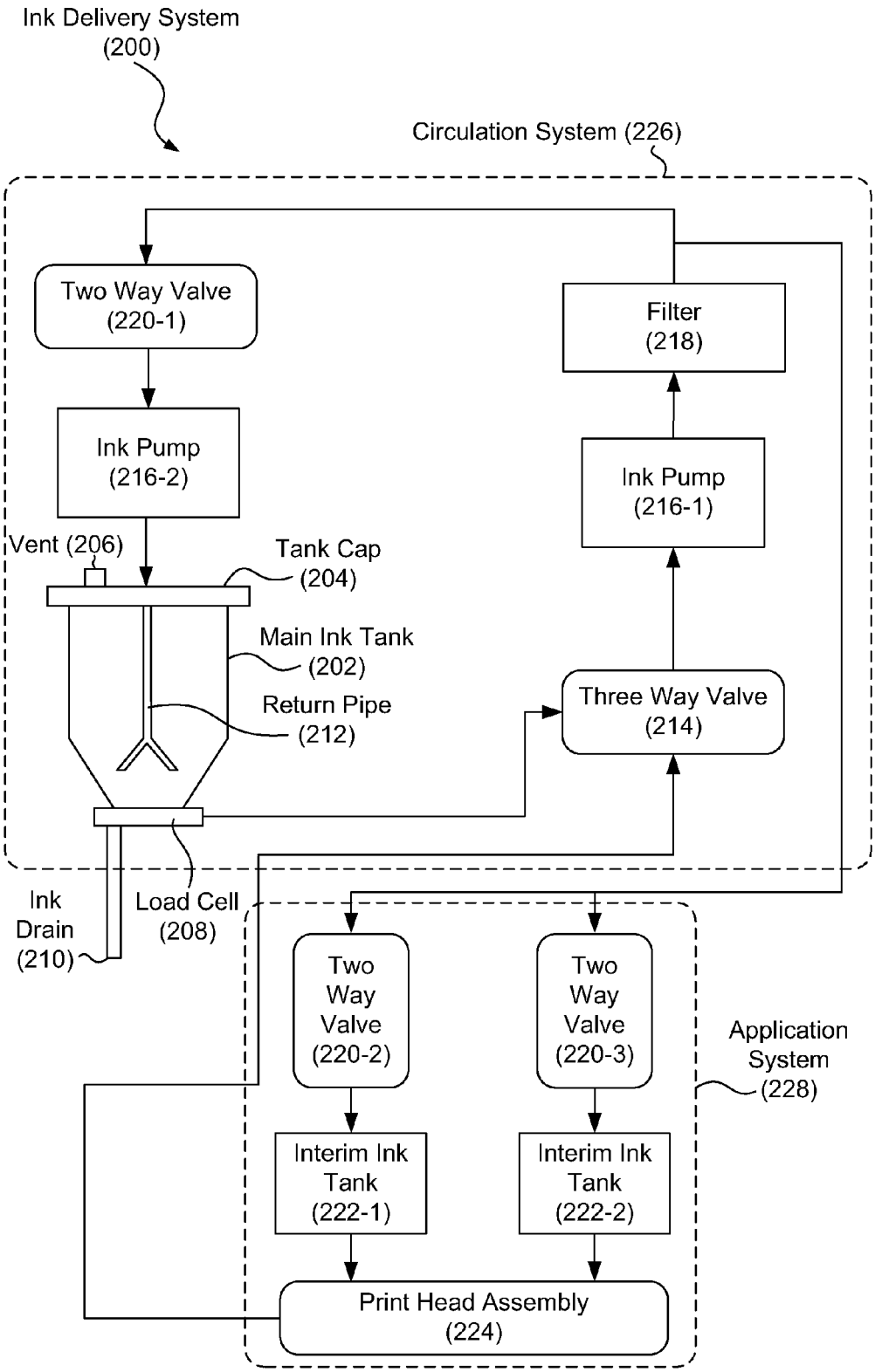
FIG. 2 is a diagram showing an illustrative white ink inkjet delivery system, according to one embodiment of principles described herein.

As indicated, FIG. 2 is a diagram showing an illustrative white ink inkjet delivery system (200). According to certain illustrative embodiments, the white ink inkjet delivery system (200) may include a circulation system (226) for circulating the white ink during a period of time between successive print jobs and an application system (228) for applying the white ink onto a substrate.

According to certain illustrative embodiments, the circulation system (200) may include a main ink tank (202), a three-way valve (214), a number of ink pumps (216-1, 216-2), a filter (218), and a two-way valve (220-1). The main ink tank (202) may include a tank cap (204) with a vent (206), a return pipe (212), a load cell (208), and an ink drain (210).

The main ink tank (202) may be used to store the bulk of the white ink present in the white ink delivery system (200). The main ink tank (202) may have a conical structure for the purpose of funneling the white ink at the bottom of the tank (202) to a load cell (208). The load cell (208) includes an ink drain (210) and a conduit for providing ink from the tank (202) to a valve (214). From the valve (214), the ink can be re-circulated into the main tank (202) or provided to an application system (228) for output. The main ink tank (202) may also have a cap (204) on top with a hole for receiving an ink return pipe (212).

The cap (204) may further include a vent (206) for allowing the ink within the tank (202) to interact with an ambient atmosphere exterior to the tank (202). The main ink tank (202) may be loaded with white ink from a reserve location either manually or automatically. Before being loaded into the main ink tank (202), the white ink may be primed. The ink may be primed by stirring and other such methods to sufficiently remove precipitate material and ensure a uniform solution of suspended white pigment particles.

In some embodiments, the ink return pipe (212) may include a number of exhaust terminations on the end. Two such terminations are illustrated in FIG. 2. However, any number of such branches is within the scope of the present disclosure. Having the ink returned to the main tank (202) through a number of exhaust terminations instead of a single straight termination may help to increase the ink flow throughout the main ink tank (202). Increasing the ink flow throughout the main ink tank (202) may reduce the precipitation rate of the white ink.

In some embodiments, the load cell (208) at the bottom of the tank may sense the weight of the ink within the main ink tank (202) such that the amount or level of the ink in the main tank (202) can be determined. Knowing the ink level within the main ink tank (202) may allow a control system (e.g., 108, FIG. 1) to determine if white ink needs to be added to or removed from the main ink tank (202).

The load cell (208) may include two openings. The first opening may be to an ink drain (210). The ink drain (210) may be used to drain the ink from the main ink tank (202) and eventually the entire ink delivery system (200) when the system is not in use for a given period of time. The second opening may allow the ink to flow to the three-way valve (214). From there, the ink may eventually flow into the application system (228).

The application system (228) is configured to apply the white ink to a substrate as desired. This application may be to create a white under layer on which a color image will be printed or may be selective to produce an image just in white ink. According to certain illustrative embodiments, the application system (228) may include a number of two-way valves (220-2, 220-3) connected to a number of interim ink tanks (222-1, 222-2). The interim ink tanks (222-1, 222-2) may direct ink into a print head assembly (224). From there, the ink may be applied to a substrate.

Figure 3:
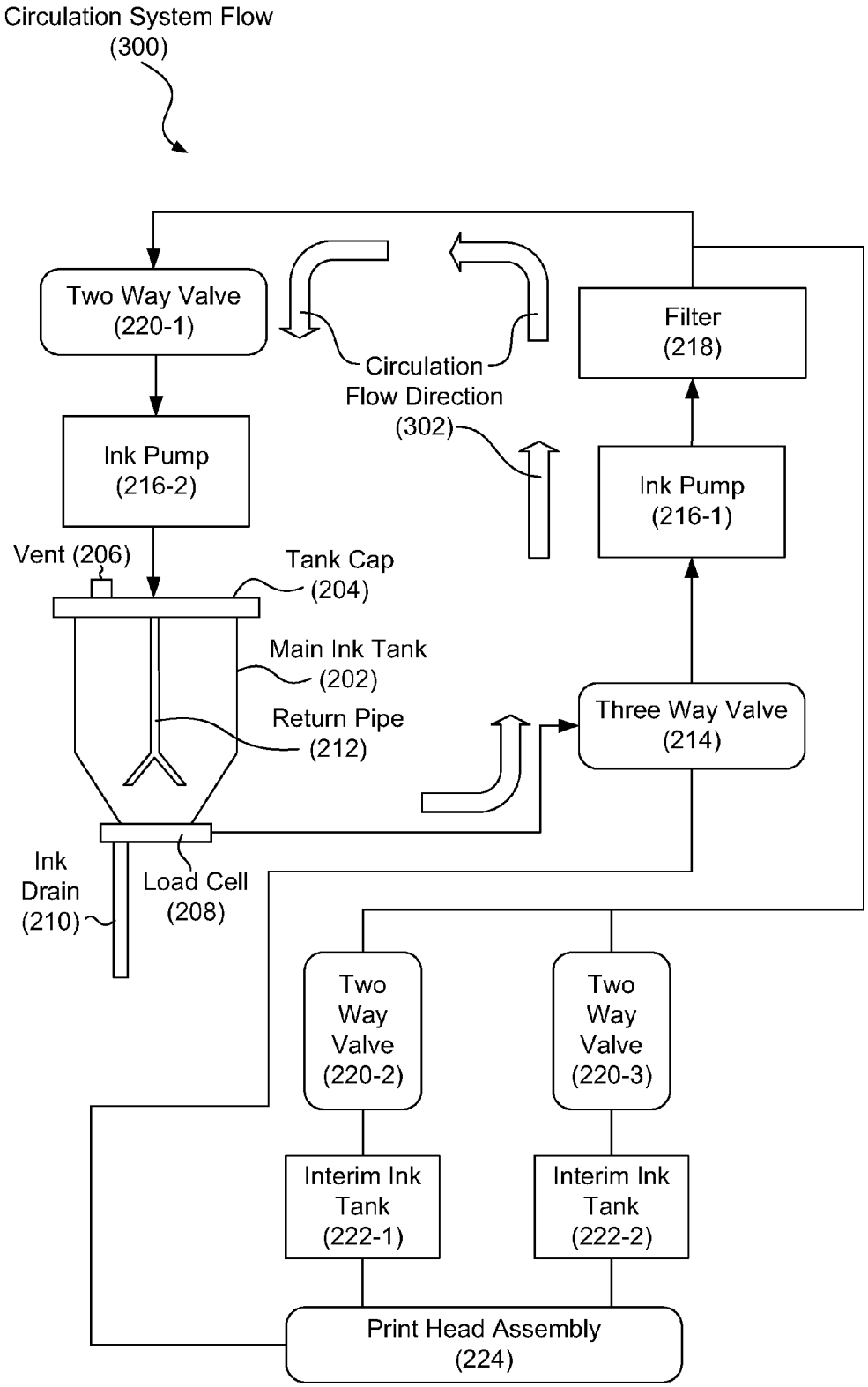
FIG. 3 is a diagram showing illustrative circulation system flow for a white ink inkjet delivery system, according to one embodiment of principles described herein.

FIG. 3 is a diagram showing an illustrative circulation system flow (300) for a white ink inkjet delivery system. According to certain illustrative embodiments, the white ink exiting the main ink tank (202) may flow through the circulation system and be returned to the main ink tank (202) through the return pipe (212). The hollow arrows shown in FIG. 3 illustrate the circulation flow direction (302) of the circulation system.

Unless the system is being drained using the ink drain (210), after exiting the main ink tank (202), the while ink flows through the load cell (2108) to the three-way valve (214). The three-way valve (214) may be configured to route the ink flow from the main ink tank (202) towards an ink filter (218). In this example, the ink is being circulated during a period of time between print jobs. Consequently, the port of the three-way valve (214) connecting to the print head assembly (224) is closed at this time.

An ink pump (216-1) may be used to pump the white ink from the three-way valve towards the filter (218). The filter (218) may be used to filter any accumulated and unwanted particles from the ink. After exiting the ink filter (218), the ink may be pumped through a two-way valve (220-1) by an ink pump (216-2) back into the main ink tank (202).

The pumps (216-1, 216-2) and valves (220-1, 214), under direction of a control system (e.g., 108, FIG. 1), may be configured to route the ink through the circulation system when it is not being output in a printing job by the application system. Thus, between print jobs, the ink may be continually circulating through the system. The continual circulation may help to reduce the rate of precipitation.

The chemical properties of white ink are such that certain particles, including the white pigment, are suspended in the ink solution. Due to the higher density of white pigments such as $TiO_2$, the particles will begin to precipitate. Upon precipitation, the white pigment particles may become clumped to form a more solid material referred to as the precipitate. The remaining ink solution may be referred to as the supernate. The precipitate material may clog the nozzles of a print head assembly and create unwanted buildup throughout the ink flow system. By reducing the rate of precipitation within the white ink solution, the ink delivery system may be protected from such buildup and nozzle clogs. As indicated above, continual circulation of the white ink by the circulation system illustrated in FIG. 3 may help to reduce the rate of precipitation.

Figure 4:
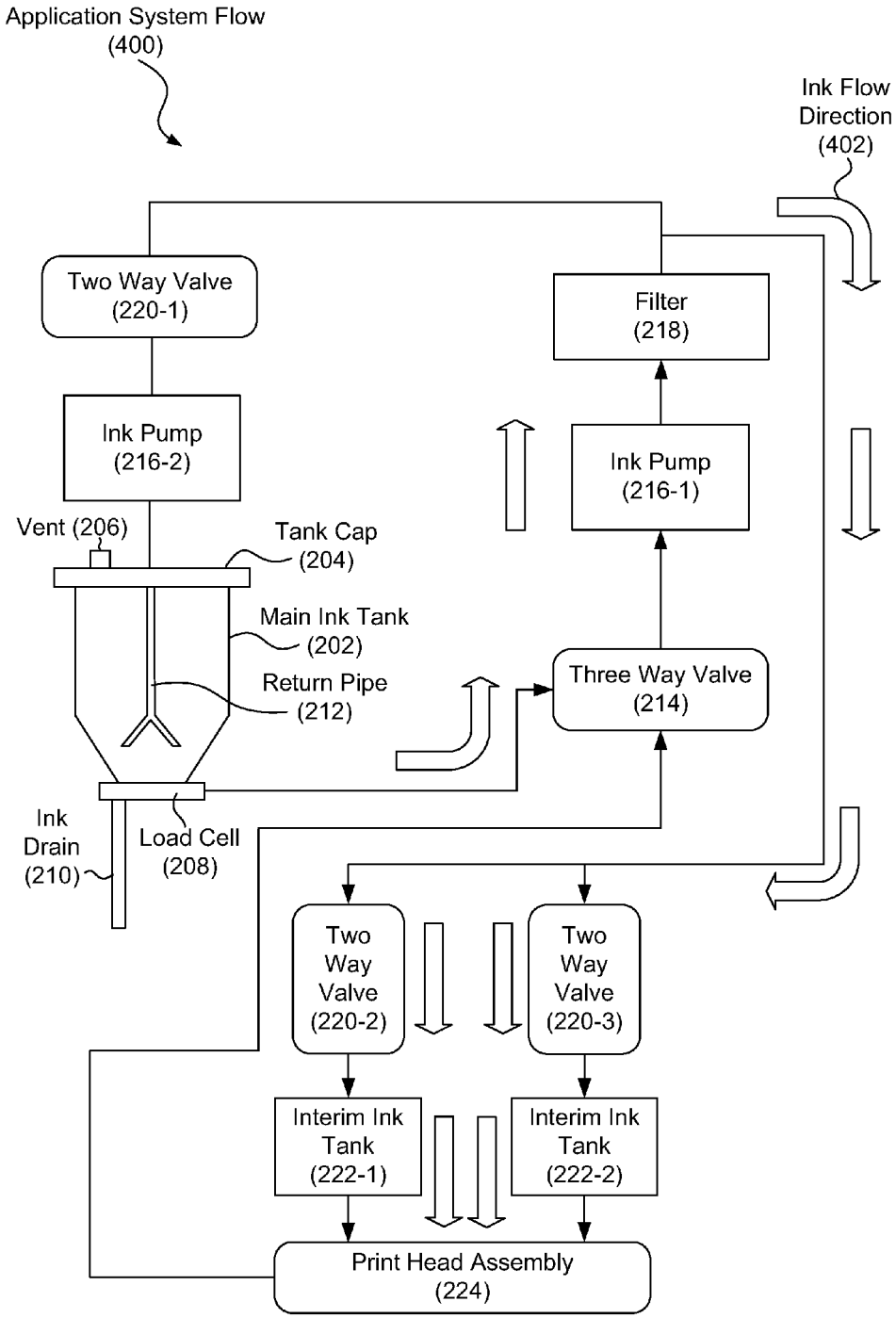
FIG. 4 is a diagram showing illustrative application system flow for a white ink inkjet delivery system, according to one embodiment of principles described herein.

FIG. 4 is a diagram showing an illustrative application system flow (400) for a white ink inkjet delivery system. According to certain illustrative embodiments, the application system may be configured to draw ink from the circulation system, described above, towards the print head assembly (224) during a print job. The hollow arrows illustrated in FIG. 4 show the ink flow direction (402) from the main ink tank (202) to the print head assembly (224).

After exiting the main ink tank (202) through the load cell (208), the white ink may flow towards the three-way valve (214). As before, the three-way valve (214) routes the ink flow from the main ink tank (202) through an ink filter (218). The valve (214) may also receive unused ink from the print head assembly (224) and route that ink flow through the filter (218) as well. In either case, an ink pump (216-1) may be used to pump the ink from the three-way valve (214) towards the filter (218).

In the configuration of FIG. 4, the two-way valve (220-1) leading back to the main ink tank (202) is closed. Additionally, the two-way valves (220-2, 220-3) to the interim ink tanks (222-1, 222-2) are opened. Consequently, the ink exiting the filter (218) will flow to the interim tanks (222-1, 222-2) instead of back to the main ink tank (202).

The interim tanks (222-1, 222-2) may act as a temporary and immediate storage for ink being delivered to the print head assembly (224). Throughout the duration of the print job, the print head assembly (224) may be applying white ink to the substrate while drawing from the interim tanks (222-1, 222-2). The interim tanks (222-1, 222-2) may include floats which indicate their current ink levels to a control system. The control system (e.g., 108, FIG. 1) may respond by configuring the ink pump (216-1) to pump more ink through the filter (218) and into the interim tanks (222-1, 222-2). Conversely, if the interim tanks (222-1, 222-2) are becoming too full, the control system (e.g., 108, FIG. 1) may respond by configuring the ink pump (216-1) to pump less ink into the interim tanks (222-1, 222-2).

As indicated, the print head assembly (224) may not use all of the ink supplied through the interim tanks (222-1, 222-2). As a result, the unused ink may flow back into the circulation system through the three-way valve (214). If the time intervals between successive print jobs are relatively short, the white ink may stay in the white ink inkjet delivery system shown in FIGS. 3 and 4. For example, if the time interval between successive print jobs ranges from 5 to 15 minutes, then the white ink may stay in the system and continue to circulate. However, if the time interval between successive print jobs exceeds a predetermined threshold, it may be beneficial to drain the white ink from the white ink inkjet delivery system in order to prevent excessive precipitation. Although the circulation may reduce the rate of precipitation, it may not eliminate the precipitation process completely. The system is drained via the ink drain (210) of the main ink tank (202)

Figure 5:
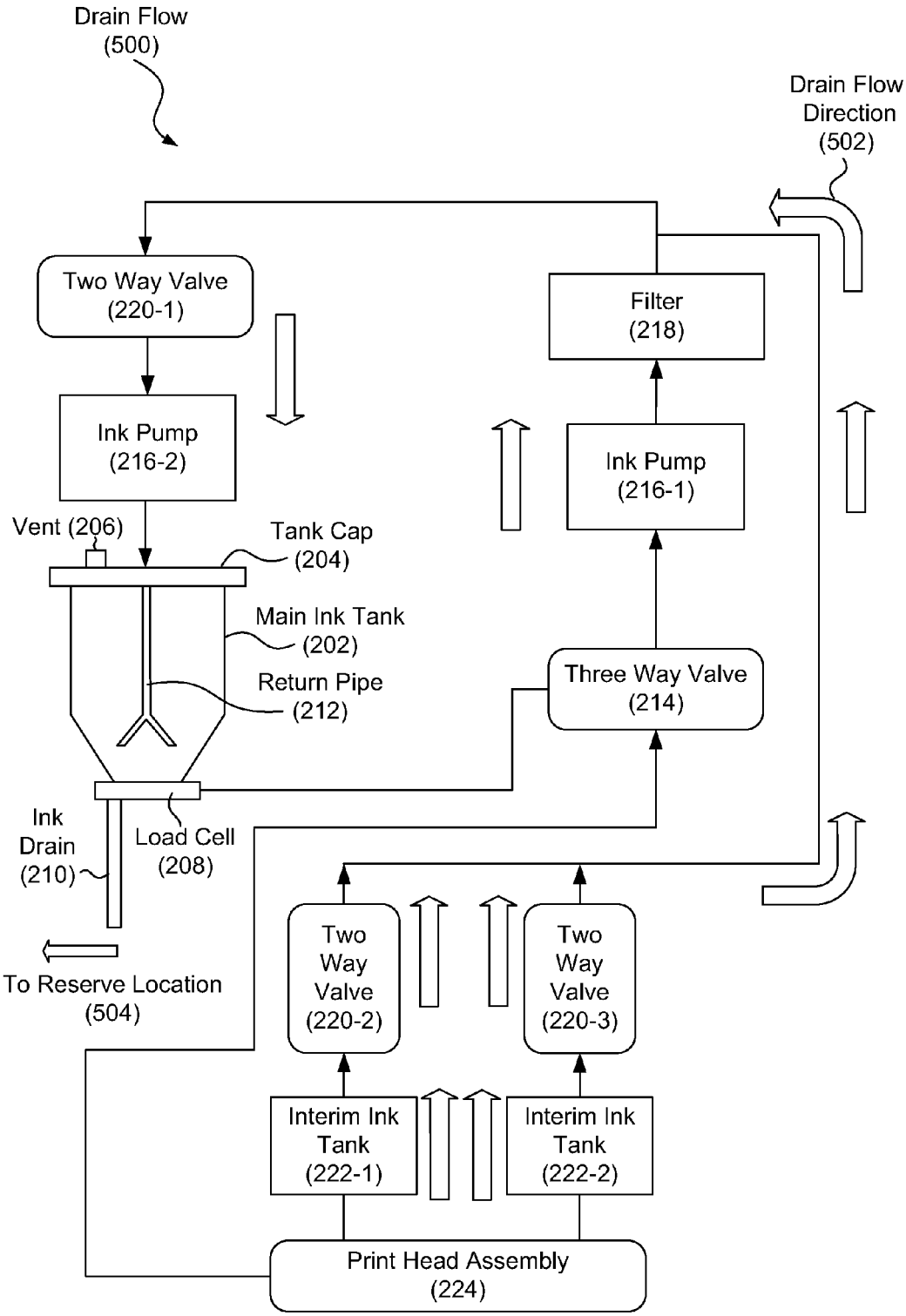
FIG. 5 is a diagram showing illustrative drain flow during a draining process for a white ink inkjet delivery system, according to one embodiment of principles described herein.

FIG. 5 is a diagram showing an illustrative drain flow (500) during a draining process for a white ink inkjet delivery system. According to certain illustrative embodiments, the ink may be pumped back through the application system and through the circulation system into the main ink tank (202). From there, the ink may be drained through the ink drain (210). The hollow arrows illustrated in FIG. 5 show the drain flow direction (502).

Under the direction of a control system (e.g., 108, FIG. 1), the pumps (216-1, 216-2) and valves (214, 220-1, 220-2, 220-3) may be configured to pump the ink back into the main ink tank (202) to be drained. In this configuration, the three-way valve (214) is closed from drawing ink from the main ink tank (202) through the load cell (208). Additionally, the two-way valves (220-1, 220-2, 220-3) are all opened.

In this configuration, the ink pump (216-1) is open to allow ink flow but need not contribute to pumping the ink. The ink pump (216-2) may operate to pump ink from all locations within the system back into the main ink tank (202). From there, the ink may be drained through the ink drain (210) to a reserve location (504).

When the system is ready to be used again, the white ink in the reserve location (504) may be reloaded back into the main ink tank (202). As mentioned above, the loading of the main ink tank (202) may be done either manually or automatically under direction of the control system (e.g., 108, FIG. 1).

During operation of the white ink inkjet delivery system, a small amount of particle buildup may have occurred. After draining, to address this buildup and prevent a larger buildup of such particles, the system may be flushed with a flushing solution. Various flushing solutions may be designed to remove the buildup of residual ink particles.

The flushing process may be performed by filling up the main ink tank (202) with the flushing solution. The ink pumps (216-1, 216-2) and valves (214, 220-1, 220-2, 220-3) of the ink delivery system may be used to appropriately pump the solution through the ink delivery system. After the system has been sufficiently flushed, the flushing solution may be drained and discarded.

Figure 6:
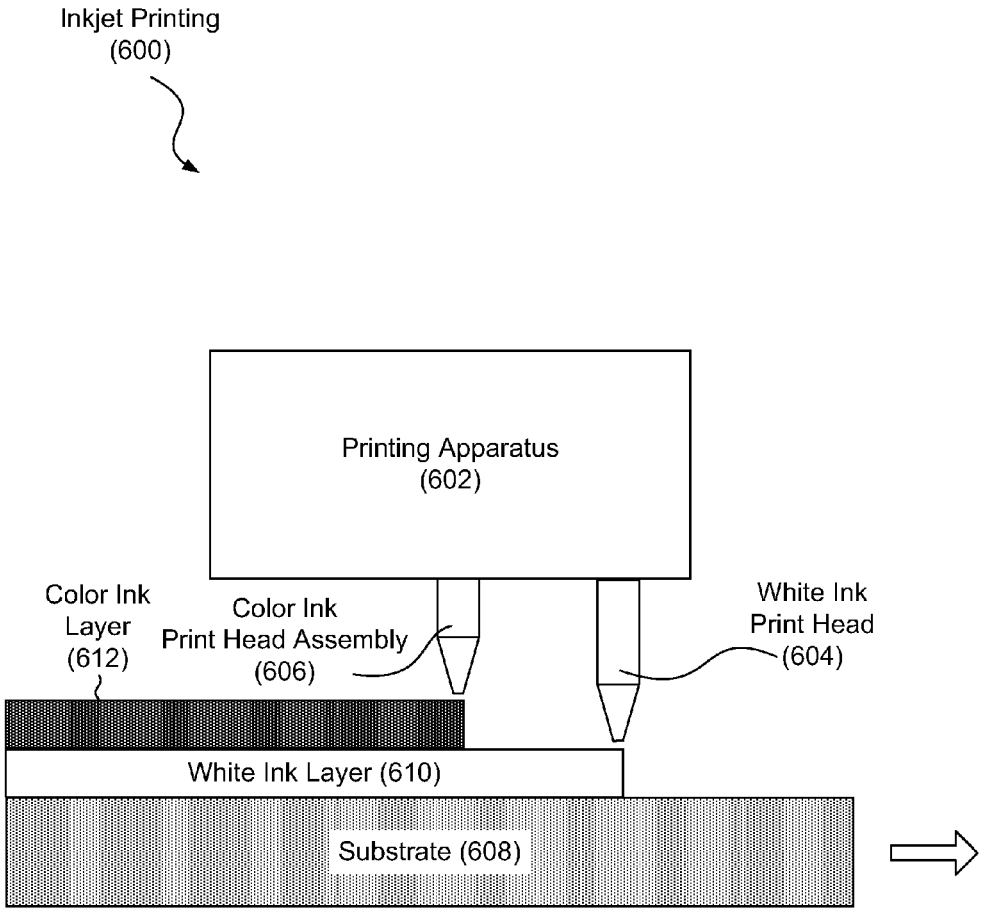
FIG. 6 is a diagram showing illustrative inkjet printing for a printing apparatus printing both white and color inks, according to one embodiment of principles described herein.

FIG. 6 is a diagram showing illustrative inkjet printing (600) for a printing apparatus printing both white and color inks. According to certain illustrative embodiments, a printing apparatus (602) may include a white ink print head assembly (604) and a color ink print head assembly (606). Thus, the printing apparatus (602) may be capable of printing color images onto a non-white substrate (608) without requiring a pre-applied white ink layer.

Operation of the printing apparatus (602) may proceed by moving a substrate underneath the print head assemblies (604, 606) of the printing apparatus (602) or moving the printing apparatus (602) with respect to the substrate. The placement of the white ink print head assembly (604) relative to the color ink print head assembly (606) may be such that the white ink print head assembly (604) deposits a white ink layer (610) before the color ink print head assembly deposits a color ink layer (212). Thus, a single printing apparatus (602) may be used to print a color image on top of a transparent or other non-white type of substrate (608). To save on white ink usage, the white ink layer (610) may be registered and co-extensive with the color ink layer (612) such that the white ink layer (610) need only be deposited in locations where a color ink layer (612) is to be applied.

In some embodiments, the printing apparatus (602) may be configured to move across a stationary substrate (608). Again, the placement of the white ink print head assembly (604) relative to the color ink print head assembly (606) may be such that the white ink print head assembly (604) deposits a white ink layer (610) before the color ink print head assembly deposits a color ink layer (212).

Figure 7:
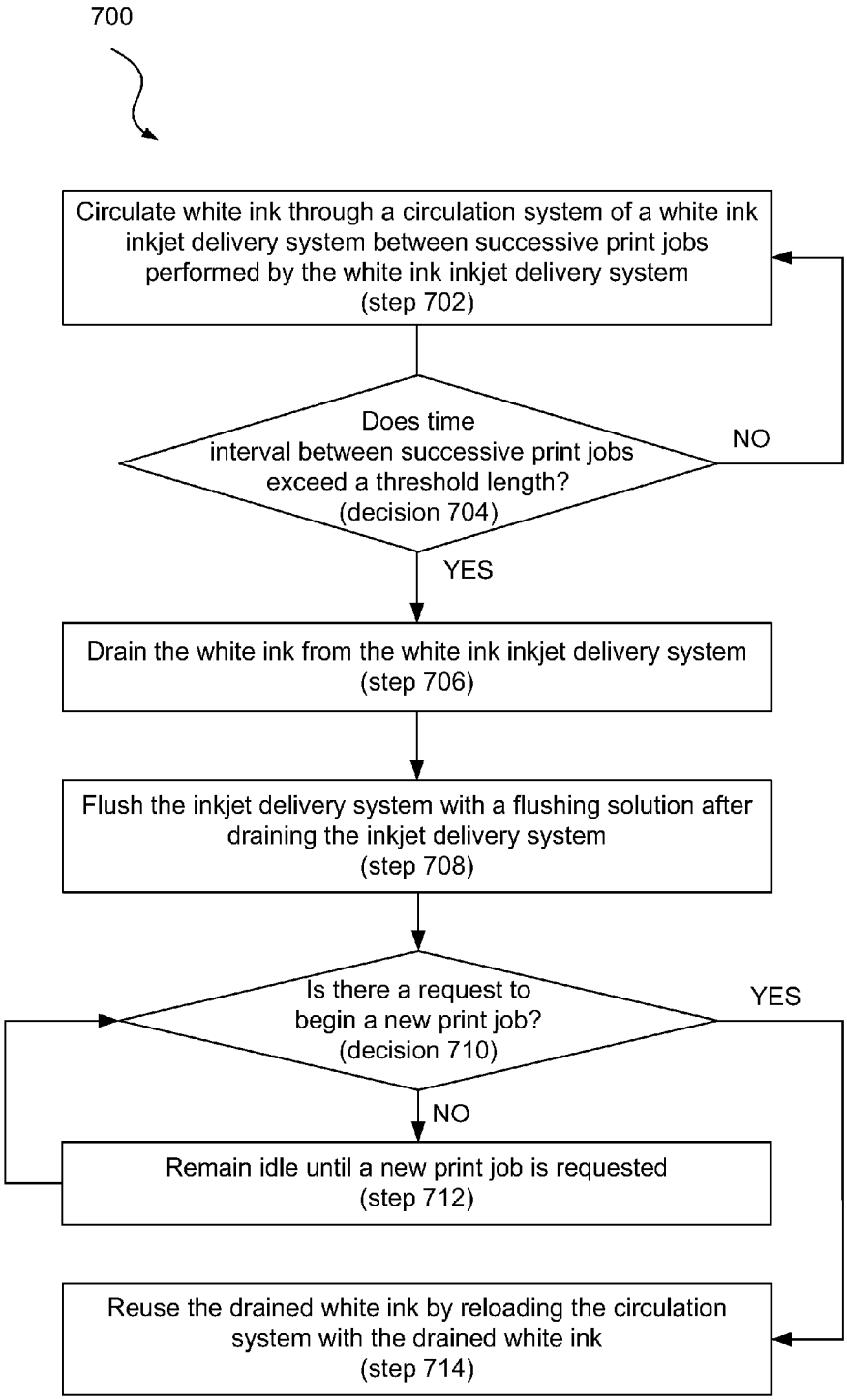
FIG. 7 is a diagram showing an illustrative method for white ink delivery, according to one embodiment of principles described herein.

FIG. 7 is a diagram showing an illustrative method (700) for white ink delivery. According to certain embodiments, the method (700) may include circulating (step 702) white ink through a circulation system of a white ink inkjet delivery system between successive print jobs performed by the white ink inkjet delivery system. The method may further include determining (decision 704) if the time interval between successive print jobs exceeds a threshold length. If the time interval between successive print jobs does not (decision 704, NO) exceed the threshold length, then the white ink inkjet delivery system may continue to circulate (step 702) ink through the circulation system of the white ink inkjet delivery system. If the time interval between successive print jobs does indeed (decision 704, YES) exceed the threshold length, then the method may continue by draining (step 704) the white ink from the white ink inkjet delivery system. After draining, the method may include flushing (step 708) the inkjet delivery system with a flushing solution. The method may further include determining (decision 710) if there is currently a request to begin a new print job. If there is not (decision 710, NO) a request to begin a new print job, the method may include remaining (step 712) idle until a print job is requested. If there is indeed (decision 710, YES) a request for a new print job, then the method continue by reusing (step 714) the drained white ink by reloading the circulation system with the drained white ink.

In sum, through use of a system or method embodying principles described herein, a practical white ink inkjet delivery system may be realized. Such a system may be combined with a color inkjet delivery system on the same printing apparatus. Thus, images being printed onto a non-white substrate may have a white ink layer and a color ink layer printed by the same machine. Additionally, printing costs may be reduced as inkjet printing is generally less expensive than other printing methods which are typically used for printing white inks.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method for white ink delivery, the method comprising:

circulating white ink through a white ink delivery system between successive print jobs; and in response to a time interval between two of said successive print jobs being greater than a threshold time interval, draining said white ink from said white ink delivery system.

2. The method of claim 1, further comprising reloading said delivery system with said white ink previously drained.

3. The method of claim 2, in which said reloading said delivery system with said drained white ink is in response to a request to initiate a print job.

4. The method of claim 2, in which said reloading said delivery system with said drained white ink is performed automatically.

5. The method of claim 1, in which said white ink delivery system is integrated with a color ink delivery system on one printing apparatus.

6. The method of claim 5, in which said printing apparatus is configured to print said white ink onto a substrate before printing a color image on said substrate.

7. The method of claim 1, in which said delivery system comprises a main ink tank, said main ink tank comprising an ink return pipe, said ink return pipe comprising a plurality of exhaust terminations for reintroducing said white ink into said main ink tank.

8. The method of claim 1, further comprising flushing said white ink delivery system with a flushing solution after draining said white ink from said white ink delivery system.

9. A system comprising:

a control system comprising a processor and a memory;

a white ink delivery system configured to apply said white ink to a substrate during a print job, said white ink delivery system comprising a circulation system configured to circulate white ink between successive print jobs;

in which said control system is configured to cause said white ink to be drained from said white ink delivery system in response to a time interval between two of said successive print jobs being greater than a threshold time interval.

10. The system of claim 9, in which said white ink delivery system is configured to again receive said drained white ink through a reloading process.

11. The system of claim 10, in which said reloading process is performed in response to a request to initiate a print job from said control system.

12. The system of claim 10, in which said reloading process is performed automatically.

13. The system of claim 9, in which said white ink delivery system is integrated with a color ink delivery system on a printing apparatus.

14. The system of claim 13, in which said printing apparatus is configured to print said white ink onto said substrate before printing a color image on said substrate.

15. The system of claim 9, in which said circulation system comprises a main ink tank, said main ink tank comprising an ink return pipe, said ink return pipe comprising a plurality of exhaust terminations for reintroducing said white ink into said main ink tank.

16. The system of claim 9, in which said control system is configured to flush at least a portion of said white ink delivery system with a flushing solution after said white ink is drained from said white ink delivery system.

17. A printing apparatus for applying white ink onto a substrate, the apparatus comprising:

a white ink delivery system, said white ink delivery system configured to:

circulate white ink between successive print jobs; and in response to a time interval between two of said successive print jobs being greater than a threshold time interval, draining said white ink from said white ink delivery system.

18. The apparatus of claim 17, in which said white ink delivery system is configured to reload said drained white ink.

19. The apparatus of claim 17, further comprising a color ink delivery system for applying colored inks onto said substrate.

20. The apparatus of claim 17, in which said white ink delivery system is further configured to flush at least a portion of said delivery system with a flushing solution after draining said white ink.

* * * * *